US005445659A

United States Patent [19]

Khan et al.

[11] Patent Number: 5,445,659

[45] Date of Patent: Aug. 29, 1995

[54] PARTIAL OXIDATION OF PRODUCTS OF LIQUEFACTION OF PLASTIC MATERIALS

[75] Inventors: Motasimur R. Khan, Wappingers Falls; Christine C. Albert, Peekskill; Stephen J. DeCanio, Montgomery, all of N.Y.

[73] Assignee: Texaco Inc., White Plains, N.Y.

[21] Appl. No.: 130,922

[22] Filed: Oct. 4, 1993

[51] Int. Cl.[6] ..... C10J 3/46

[52] U.S. Cl. ..... 48/197 R; 48/206; 48/209; 48/DIG. 7; 208/433; 252/373; 585/241

[58] Field of Search ..... 48/197 R, 206, 209, 48/DIG. 7; 252/373; 585/240, 241; 208/400, 433, 434; 44/628; 588/205, 213, 220, 226, 216

[56] References Cited

U.S. PATENT DOCUMENTS

| | | | |
|---|---|---|---|
| 3,607,718 | 9/1971 | Leoders et al. | 208/434 |
| 3,704,108 | 11/1972 | Alpert | 585/241 |
| 3,856,658 | 12/1974 | Wolk et al. | 208/434 |
| 4,089,773 | 5/1978 | Espenscheid | 585/241 |
| 4,159,238 | 6/1979 | Schmid | 48/197 R |
| 4,175,211 | 11/1979 | Chen et al. | 585/241 |
| 4,402,821 | 9/1983 | Yon | 208/434 |
| 4,443,230 | 4/1984 | Stellaccio | 48/DIG. 7 |
| 4,468,376 | 8/1984 | Suggitt | 423/368 |
| 4,510,037 | 4/1985 | Johanson et al. | 208/434 |
| 4,642,401 | 2/1987 | Coenen et al. | 585/241 |
| 4,944,866 | 7/1990 | Fuhrmann et al. | 208/434 |
| 4,982,027 | 1/1991 | Korff et al. | 585/241 |
| 5,288,934 | 2/1994 | Frogioville | 585/240 |
| 5,364,996 | 11/1994 | Castagnoli et al. | 585/241 |

FOREIGN PATENT DOCUMENTS

| | | | |
|---|---|---|---|
| 2357636 | 7/1976 | France | 585/241 |
| 3602041 | 7/1987 | Germany | 585/240 |
| 0058486 | 4/1985 | Japan | 585/240 |

*Primary Examiner*—Peter Kratz
*Attorney, Agent, or Firm*—George J. Darsa

[57] ABSTRACT

A process for converting scrap plastic material into a high quality transportation fuel. The plastic material is granulated and mixed with granulated solid carbonaceous fuel e.g. coal and liquid hydrocarbonaceous solvent e.g. waste motor oil to produce a plastic-containing sludge. The plastic-containing sludge is liquefied in a closed autoclave while in contact with hydrogen gas. A pumpable slurry from the autoclave is heated and fractionated in a fractionation zone to produce a hydrocarbonaceous distillate which may be used for transportation fuel. A bottoms stream from the fractionation zone comprising liquid hydrocarbonaceous material and inorganic material is reacted by partial oxidation to produce nontoxic slag and raw synthesis gas, fuel gas or reducing gas which may be purified in a gas purification zone.

13 Claims, No Drawings

PARTIAL OXIDATION OF PRODUCTS OF LIQUEFACTION OF PLASTIC MATERIALS

FIELD OF THE INVENTION

This invention relates to an environmentally safe method for disposing of scrap plastic materials. More particularly, it pertains to a process for converting scrap plastic materials into a high quality transportation fuel.

Scrap plastics are solid organic polymers and are available in such forms as sheets, extruded shapes, moldings, reinforced plastics, laminates, and foamed plastics. About 60 billion pounds of plastics are sold in the United States each year. For example, automobiles are increasingly being manufactured containing more plastic parts. A large part of these plastic materials wind up as scrap plastics in landfills. Although plastics account for only a small portion of the waste dumped in landfills i.e. about 7 wt. % and about 20 percent by volume, burying them is getting increasingly difficult. The cost of landfilling this material in 1993 is between $12 to $100 per ton (excluding shipping costs); and this cost is rising. Landfills are not universally viewed as an acceptable, or even a tolerable option for the disposal of plastic materials. Due to the combined effects of the unpopularity of existing facilities and the need for land to allow normal growth of populations, new landfills have been all but banned in many parts of the world. Existing facilities are also facing finite limits as to how long they may continue to function. Also, toxic wastes from buried plastics seep into and pollute underground streams which are commonly the source of our fresh water. Further, on-site burning or incineration which are alternative disposal methods are in disfavor because they generate heavy air pollution from noxious gases and soot. With respect to recycling plastics, it has been economically feasible to recycle only about 1 wt. % of the scrap plastics. It is obvious from the aforesaid that the disposal of scrap plastics is one of the nation's most pressing environmental problems.

Advantageously by the subject environmentally acceptable process, a wide range of waste plastic feedstocks are safely disposed. Useful synthesis gas, reducing gas or fuel gas is produced. Further, the relatively medium heating value of the plastic material e.g. greater than about 3,000 Btu/lb is made available for heating internal process streams or producing by-product hot water or steam.

SUMMARY OF THE INVENTION

This invention relates to an environmentally acceptable process for converting a wide range of solid carbonaceous plastic materials into a high quality transportation fuel and includes the partial oxidation of a fractionator bottoms stream comprising liquid hydrocarbonaceous material and separated inorganic material; wherein synthesis gas, reducing gas, or fuel gas is produced by said process comprising the steps of:

(1) granulating solid carbonaceous plastic material;

(2) mixing about 25 to 48 parts by wt. of the granulated solid carbonaceous plastic material from (1) with about 4 to 50 parts by wt. of a pumpable liquid hydrocarbonaceous solvent, and about 5 to 48 parts by wt. of granulated solid carbonaceous fuel to produce a plastic-containing sludge having a solids content in the range of about 45 to 96 wt. %;

(3) liquefying the plastic-containing sludge from (1) in a closed autoclave at a temperature in the range of about 500° F. to 1500° F. and a pressure in the range of 150 psig to 2700 psig while said plastic-containing sludge is in contact with hydrogen gas in the amount of about 0.1 to 1.0 parts by wt. of hydrogen gas per part by weight of plastic-containing sludge; wherein said reaction is continued until a pumpable slurry is produced comprising the following materials in weight percent room temperature and pressure:

a. a slurry comprising solubilized plastic, 50 to 95 solubilized solid carbonaceous fuel, and hydrocarbonaceous liquid solvent b. unconverted organic and inorganic material 5 to 50

(4) separating a gas mixture comprising $H_2$, CO, $CO_2$, $C_1$–$C_6$ gases, $H_2O$, and a trace of $H_2S$ from the autoclave in (3), thereby leaving a pumpable slurry;

(5) fractionating the degassed pumpable slurry from (4) in a distillation zone to produce:

a. a hydrocarbonaceous distillate comprising a mixture of $C_5$ to $C_{30}$ compounds selected from the group consisting of naphthenes, paraffins, aromatics, olefins, and mixtures thereof, wherein said distillate has an initial atmospheric boiling point in the range of about 130° F. to 500° F., a viscosity in the range of about 100 to 1500 centipoise at room temperature, and a specific gravity of about 0.7 to 1.1;

b. a bottoms stream comprising aromatic and paraffinic hydrocarbonaceous materials containing $C_{20}$ or higher compounds in admixture with inorganic material from said plastic and solid carbonaceous fuel; wherein said bottoms stream has an initial boiling point in the range of about 300° F. to 1500° F., a viscosity in the range of about 1500 to 15,000 cP at room temperature, a solids content in the range of about 60 to 90 wt. %, a specific gravity of 0.9–1.3; and (6) reacting by partial oxidation in a free-flow partial oxidation gasifier with a free-oxygen containing gas in the presence of a temperature moderator said bottoms stream (5) (b) to produce raw synthesis gas, fuel gas or reducing gas, and slag.

DESCRIPTION OF THE INVENTION

Scrap plastics are disposed of by the process of the subject invention without polluting the nation's environment. Simultaneously, useful by-product nonpolluting synthesis gas, reducing gas, fuel gas and nonhazardous slag are produced.

The scrap plastic materials which are processed as described herein include at least one solid carbonaceous thermoplastic and/or thermosetting material that may or may not contain associated inorganic matter e.g. fillers and reinforcement material. Sulfur is also commonly found in scrap plastics. Scrap plastic materials may be derived from obsolete equipment, household containers, packaging, industrial sources and junked automobiles. The mixture of plastics is of varying age and composition. With the presence of varying amounts of incombustible inorganic matter compounded in the plastic as fillers, catalysts, pigments and reinforcing agents, recovery of the plastic material is generally impractical. Further, complete combustion can release toxicnoxious components including volatile metals and hydrogen halides. Associated inorganic matter in the scrap solid carbonaceous plastic may include fillers such as titania, talc, clays, alumina, barium sulfate and carbonates. Catalysts and accelerators for thermosetting plastics include tin compounds for polyurethanes, and cobalt and manganese compounds for polyesters. Dyes and pigments such as compounds of cadmium, chromium, cobalt, and copper; nonferrous metals such as aluminum and copper in plastic coated wire cuttings; metal films; woven and nonwoven fiber glass, graphite, and boron reinforcing agents; steel, brass, and nickel metal inserts; and lead compounds from plastic automotive batteries. Other heavy metals e.g. cadmium, arsenic, barium, chromium, selenium, and mercury may be also present. The inorganic constituents may be present in the solid carbonaceous plastic-containing material in the amount of about a trace amount to about 60 wt. % of said solid carbonaceous plastic-containing material, such as about 1 to 20 wt. %. The scrap plastic material may be in the form of sheets, extruded shapes, moldings, reinforced plastics, and foamed plastics.

FIG. 1 gives a breakdown of 1991 sales in the United States of applicable solid carbonaceous plastics.

FIG. 1

| Material | Million lbs. 1991 |
|---|---|
| Acrylobutadienestyrene (ABS) | 1,125 |
| Acrylic | 672 |
| Alkyd | 315 |
| Cellulosic | 840 |
| Epoxy | 428 |
| Nylon | 536 |
| Phenolic | 2,556 |
| Polyacetal | 140 |
| Polycarbonate | 601 |
| Polyester, thermoplastic | 2,549 |
| Polyester, unsaturated | 1,081 |
| Polyethylene, high density | 9,193 |
| Polyethylene, low density | 12,143 |
| Polyphenylene-based alloys | 195 |
| Polypropylene and copolymers | 8,155 |
| Polystyrene | 4,877 |
| Other styrenes | 1,180 |
| Polyurethane | 2,985 |
| Polyvinylchloride and copolymers | 9,130 |
| Other vinyls | 120 |
| Styrene acrylonitrile (SAN) | 117 |
| Thermoplastic elastomers | 584 |
| Urea and melamine | 1,467 |
| Others | 345 |
| Total | 60,598 |

The solid carbonaceous plastic material that may contain associated inorganic matter e. g. filler or reinforcement material, has a higher heating value (HHV) in the range of about 3000 to 19,000 BTU per lb of solid carbonaceous plastic-containing material. The plastic material is granulated by conventional means to a maximum particle dimension of about ¼", such as about ⅛". Granulating is the preferred method for reducing plastic. Any conventional plastic granulator and mill may be used. For example, a granulator will readily shred/grind solid plastic pieces to a particle size which passes through ASTM E 11 Alterative Sieve Designation ¼ or less. A mill can take the product from the granulator (i.e., −¼") and readily convert it to smaller sizes (−⅛" or less), such as ASTM E11 Alternative Sieve Designation No. 7 or less. For example, a suitable granulator and mill are made by Enteleter Inc., 251 Welton St., Hamden, Conn. 06517. The ash content for an as-received granulated sample of automotive crusher plastic residue (ACR) is 58.2 wt %.

About 25 to 48 parts by weight of the granulated solid carbonaceous plastic material is mixed together with about 4 to 50 parts by wt. of a liquid slurrying medium comprising a liquid hydrocarbonaceous solvent and about 5 to 48 parts by wt. of granulated solid carbonaceous fuel to produce a sludge material having a solids content in the range of about 45 to 95 wt. % and having a minimum higher heating value (HHV) of about 10,000 BTU/lb. of slurry.

By definition, the term liquid hydrocarbonaceous solvent as used herein to describe suitable liquid solvents is a liquid hydrocarbonaceous fuel selected from the group consisting of liquefied petroleum gas, petroleum distillates and residues, gasoline, naphtha, kerosine, crude petroleum, asphalt, gas oil, residual oil, tar sand oil and shale oil, coal derived oil, aromatic hydrocarbons (such as benzene, toluene, xylene fractions), coal tar, cycle gas oil from fluid-catalytic-cracking operations, furfural extract of coker gas oil, and mixtures thereof. Waste hydrocarbon motor oil may also be used as a liquid solvent. Hydrocarbon oils having the following properties are suitable: initial atmospheric boiling point, greater than 500° F.; Neutralization No., mg KOH/g 0.70 to 1.0; and Aniline point °F. 100 to 110. Other suitable oils comply with ASTM specification D2226, Types 101 and 102. The expression "A and/or B" is used herein in its usual manner and means A or B or A and B.

The term solid carbonaceous fuels, as used herein to describe suitable solid carbonaceous feedstocks, is intended to include various materials and mixtures thereof from the group consisting of coal, coke from coal, char from coal, coal liquefaction residues, petroleum coke, particulate carbon soot, and solids derived from oil shale, tar sands, and pitch. All types of coal may be used including anthracite, bituminous, sub-bituminous, and lignite. The particulate carbon soot may be that which is obtained as a byproduct of the subject partial oxidation process, or that whicih is obtained by burning fossil fuels. The amount of inorganic matter e.g. ash in solid carbonaceous fuels in weight percent may be in the range of about 0.2 for petroleum coke to 20 for coal. The ash particles in the hot gas stream have not reached the melting temperature of the mineral matter originally contained in the solid fuel. These ash particles are typically less than 74 microns in size. Typical compositions of the ash particles in the gas stream from a coal feed for example in wt. % follow: $SiO_2$ 58.8–62.6; $Al_2O_3$ 15.8–20.0; $Fe_2O_3$ 3.3–5.1; $TiO_2$ 0.8–1.4; CaO 5.3–7.6; MgO 0.5–1.6; $Na_2O$ 0.2–0.4; $K_2O$ 0.4–0.7; $P_2O_3$ 0.1–0.3; and $SO_3$ 0.9–3.2.

The sludge material is introduced into a closed autoclave where the granulated plastic material and solid carbonaceous fuel are directly contacted by said pumpable liquid hydrocarbonaceous solvent and hydrogen gas. About 4 to 50 parts by weight of liquid hydrocarbonaceous solvent and about 0.1 to 1.0 parts by weight of hydrogen gas contact each part by weight of plastic material and each part by weight of solid carbonaceous fuel. In one embodiment, the hydrogen gas is derived from a portion of the synthesis gas produced subsequently in the process. The temperature in the autoclave is in the range of about 500° F. to 1500° F. The pressure in the autoclave is in the range of about 270 psig to 2750 psig. Liquefaction of the organic portions of the plastic and solid carbonaceous fuel by contact with the hot hydrocarbonaceous liquid solvent and hydrogen gas takes place over a period of time in the range of about 5.0 min. to 5.0 hrs, such as about 60 minutes. The heating and liquefaction step is continued until a pumpable slurry is produced which when cooled to room temperature and pressure comprises the following ingredients in wt. %:

| | | |
|---|---|---|
| a. | a slurry comprising solubilized plastic, solubilized solid carbonaceous fuel, and | 50 to 95 |
| b. | unconverted organic and inorganic material | 5 to 50 |

The solubilized plastic and solubilized solid carbonaceous fuel is that portion of the granulated plastic material and the solid carbonaceous fuel that is liquefied by contact with liquid hydrocarbonaceous solvent and hydrogen. The slurry in a. has an initial atmospheric boiling point in the range of about 180° F. to 600° F. and a specific gravity in the range of about 0.8 to 1.2. It comprises $C_5$ to $C_{35}$ compounds selected from the group consisting of naphthenes, aromatics, olefinics, and mixtures thereof. The unconverted organic and inorganic material is the material produced by the solvent liquefaction treatment of the granulated plastic material and solid carbonaceous fuel that is not liquefied and may be easily separated from the remainder of the slurry by settling, screening, filtering, or centrifuging. The density of these materials is greater than 1.2. Typical inorganic compounds are selected from the group consisting of silica, alumina, calcium carbonate, and mixtures thereof. Also included are the oxides and/or sulfides of Na, Ca, Mg, Fe, and mixtures thereof. The unconverted organic material represents that portion of the carbon-containing compounds in the feed that is not readily converted during the liquefaction step and is composed of carbonaceous material containing carbon, hydrogen, nitrogen and sulfur.

The autoclave is vented and a gas mixture comprising the following is separated from the pumpable slurry: $H_2$, CO, $CO_2$, $C_1$–$C_6$ gases, $H_2O$ and $H_2S$. The vented gases may be sent to a partial oxidation gasifier (to be further described) as a supplemental fuel, or purified in a conventional gas purification zone prior to discharge.

The degassed pumpable slurry comprising solubilized plastic and solid carbonaceous fuel, hydrocarbonaceous liquid solvent, separated inorganic material,, and unseparated inorganic material is heated in a conventional distillation zone and fractionated into a distillate having an initial atmospheric boiling point in the range of about 130° F. to 500° F., a viscosity in the range of about 100 cP to 1500 cP at room temperature, and a specific gravity in the range of about 0.7 to 1.1. The distillate comprises $C_5$ to $C_{25}$ compounds selected from the group consisting of naphthenes, aromatics, olefinics, and mixtures thereof. The bottoms stream from the fractionator comprises liquid hydrocarbonaceous material and said. unconverted organic and inorganic material. The bottoms stream has an initial boiling point in the range of about 300° F. to 1500° F., a viscosity in the range of about 1500 cP to 15,000 cP at room temperature, a specific gravity in the range of about 0.9 to 1.3, a solids content in the range of about 60 to 90 wt. %, and comprises compounds having greater than $C_{30}$ carbon atoms. The distillate material was found to be a high quality transportation fuel.

The aforesaid bottoms stream, a temperature moderator e.g. $H_2O$, $CO_2$, and a stream of free-oxygen containing gas are introduced into the reaction zone of a free-flow unobstructed downflowing vertical refractory lined steel wall pressure vessel where the partial oxidation reaction takes place for the production of synthesis gas, reducing gas, or fuel gas. A typical gas generator is shown and described in coassigned U.S. Pat. No. 3,544,291, which is incorporated herein by reference.

A two, three or four stream annular type burner, such as shown and described in coassigned U.S. Pat. Nos. 3,847,564, and 4,525,175, which are incorporated herein by reference, may be used to introduce the feedstreams into the partial oxidation gas generator. With respect to U.S. Pat. No. 3,847,564, free-oxygen containing gas, for example in admixture with steam, may be simultaneously passed through the central conduit 18 and outer annular passage 14 of said burner. The free-oxygen containing gas is selected from the group consisting of substantially pure oxygen i.e. greater than 95 mole % $O_2$, oxygen-riched air i.e. greater than 21 mole % $O_2$, and air. The free-oxygen containing gas is supplied at a temperature in the range of about 100° F. to 1000° F. The aforesaid bottoms stream (b) is passed into the reaction zone of the partial oxidation gas generator by way of the intermediate annular passage 16 at a temperature in the range of about ambient to 650° F. In another embodiment, the aforesaid stream of vent gas may be simultaneously introduced into the free-flow gas generator by way of a separate passage in the burner and reacted by partial oxidation simultaneously with the partial oxidation reaction of said bottoms stream.

The burner assembly is inserted downward through a top inlet port of the noncatalytic synthesis gas generator. The burner extends along the central longitudinal axis of the gas generator with the downstream end discharging a multiphase mixture of fuel, free-oxygen containing gas, and temperature moderator such as water, steam, or $CO_2$ directly into the reaction zone.

The relative proportions of fuels, free-oxygen containing gas and temperature moderator in the feedstreams to the gas generator are carefully regulated to convert a substantial portion of the carbon in the fuel feedstream, e.g., up to about 90% or more by weight, to carbon oxides; and to maintain an autogenous reaction zone temperature in the range of about 1800° F. to 3500° F. Preferably the temperature in the gasifier is in the range of about 2400° F. to 2800° F., so that molten slag is produced. The pressure in the partial oxidation reaction zone is in the range of about 1 to 30 atmospheres. Further, the weight ratio of $H_2O$ to carbon in the feed is in the range of about 0.2–3.0 to 1.0, such as about 0.5–2.0 to 1.0. The atomic ratio of free-oxygen to carbon in the feed is in the range of about 0.8–1.5 to 1.0, such as about 0.9–1.2 to 1.0. By the aforesaid operating conditions, a reducing atmosphere comprising $H_2$+CO is produced in the reaction zone along with nontoxic slag.

The dwell time in the partial oxidation reaction zone is in the range of about 1 to 15 seconds, and preferably in the range of about 2 to 8 seconds. With substantially pure oxygen feed to the gas generator, the composition of the effluent gas from the gas generator in mole % dry basis may be as follows: $H_2$ 10 to 60, CO 20 to 60, $CO_2$ 5 to 60, $CH_4$ nil to 5, $H_2S$+COS nil to 5, $N_2$ nil to 5, and Ar nil to 1.5. With air feed to the gas generator, the composition of the generator effluent gas in mole % dry basis may be about as follows: $H_2$ 2 to 20, CO 5 to 35, $CO_2$ 5 to 25, $CH_4$ nil to 2, $H_2S$+COS nil to 3, $N_2$ 45 to 80, and Ar 0.5 to 1.5. Unconverted carbon, ash, or molten slag are contained in the effluent gas stream. Depending on the composition and use, the effluent gas stream is called synthesis gas, reducing gas, or fuel gas. For example, synthesis gas comprises mixtures of $H_2+CO$ that can be used for chemical synthesis; reducing gas is rich in $H_2+CO$ and is used in reducing reactions; and fuel gas comprises mixtures of $H_2+CO$, and may also includes $CH_4$. Advantageously, in the extremely hot reducing atmosphere of the gasifier, the toxic elements in any inorganic matter from the solid carbonaceous plastic and fuel materials are captured by the noncombustible constituents present and converted into nontoxic nonleachable slag. This permits the nontoxic slag to be sold as a useful by-product. For example, the cooled slag may be ground or crushed to a small particle size e.g. less than ⅛" and used in road beds or building blocks.

The hot gaseous effluent stream from the reaction zone of the synthesis gas generator is quickly cooled below the reaction temperature to a temperature in the range of about 250° F. to 700° F. by direct quenching in water, or by indirect heat exchange for example with water to produce steam in a gas cooler. The cooled gas stream may be cleaned and purified by conventional methods. For example, reference is made to coassigned U.S. Pat. No. 4,052,176, which is included herein by reference for removal of $H_2S$, COS, and $CO_2$. Advantageously, when gasifying plastics that contain halides such as polyvinylchloride, polytetrafluoroethylene, by partial oxidation, the halide is released as hydrogen halide (i.e. HCl, HF) and is scrubbed out of the synthesis gas with water containing ammonia or other basic materials. Plastics that contain bromine-containing fire retardants may be similarly treated. Reference is made to coassigned U.S. 4,468,376 which is incorporated herein by reference.

The following examples illustrate the subject invention and should not be construed as limiting the scope of the invention.

EXAMPLES

Example 1

4 tons per day of a mixture comprising several types of plastic that are found in post consumer plastics, from the following resins: polystyrene, polyamide, polyurethane, polyvinylchloride, polypropylene, and others are shredded to a particle dimension of less than about ⅛ and mixed with 0.5 tons per day of bituminous coal having a particle size of less than ⅛. The mixture of plastic and coal are mixed with 2 tons per day of waste hydrocarbon motor oil having an initial atmospheric boiling point in the range of about 250° F. to 500° F. to produce a plastic-containing sludge. The ultimate chemical analysis of the shredded mixture of plastics is shown in Table I. The chemical analysis of the ash in the mixture of plastics is shown in Table II.

TABLE I

Dry Analysis of Mixture of Plastics In Example 1.

| | Weight Percent |
|---|---|
| C | 84.0 |
| H | 13.0 |
| N | 0.4 |
| S | 0.5 |
| O | 0.1 |
| Ash | 2.0 |

TABLE II

Chemical Analysis of the Ash Present In the Mixture of Plastics In Example 1.

| | Wt. % |
|---|---|
| $SiO_2$ | 33.20 |
| $Al_2O_3$ | 6.31 |
| $Fe_2O_3$ | 22.00 |
| CaO | 29.20 |
| MgO | 0.94 |
| $Na_2O$ | 1.27 |
| $K_2O$ | 0.43 |
| $TiO_2$ | 0.89 |
| $P_2O_3$ | 0.92 |
| $Cr_2O_3$ | 0.28 |
| ZnO | 2.31 |
| PbO | 0.09 |
| BaO | 0.80 |
| CuO | 0.89 |
| NiO | 0.47 |

The plastic-containing sludge is liquefied in a closed autoclave while in contact with hydrogen gas at a temperature of about 800° F. and a pressure of about 1000 psig. About 1.0 parts by wt. of hydrogen gas is in contact with each part by wt. of plastic-containing sludge. The reaction is continued for 0.5 hrs. to produce a pumpable slurry comprising the following ingredients in wt. % when measured at room temperature and pressure: a. solubilized plastic, solubilized solid carbonaceous fuel, and hydrocarbonaceous liquid solvent 68, and b. unconverted organic and inorganic material 32. Gases from the autoclave are sent to a conventional gas purification zone. The degassed pumpable slurry at the temperature in the autoclave is heated and fractionated to produce a hydrocarbonaceous distillate having an initial atmospheric boiling point of 200° F., and a viscosity of 200 cP, when measured at room temperature. The bottoms stream from the fractionation zone, comprising a pumpable slurry of liquid hydrocarbonaceous material and said, unconverted organic and inorganic material is reacted by partial oxidation in a conventional free flow noncatalytic gas generator at a temperature of about 2400° F. and a pressure of about 500 psig with about 6 tons per day of a free-oxygen containing gas in the presence of a temperature moderator e.g. $H_2O$ to produce raw synthesis gas, fuel gas, or reducing gas, and slag. Objectionable gases e.g. $H_2S$, COS, $CO_2$ may be removed from the aforesaid raw gas streams in a conventional gas purification zone. Synthesis gas comprising $H_2+CO$ is produced along with about 0.05 tons of slag. Upon cooling, the slag is a coarse, glassy nonleachable material. If however, the same mixture of plastics were fully combusted in air, the slag may contain toxic elements, e.g. chromium in a leachable form.

Other modifications and variations of the invention as hereinbefore set forth may be made without departing from the spirit and scope thereof, and therefore, only such limitations should be imposed on the invention as are indicated in the appended claims.

We claim:

1. A partial oxidation process consisting essentially of:

1) granulating solid carbonaceous plastic material;

2) mixing about 25 to 48 parts by wt. of the granulated solid carbonaceous plastic material from (1) with about 4 to 50 parts by wt. of a pumpable liquid hydrocarbonaceous solvent, and about 5 to 48 parts by wt. of granulated solid carbonaceous fuel to produce a plastic-containing sludge having a solids content in the range of about 45 to 96 wt. %;

3) liquefying the plastic-containing sludge from (1) in a closed autoclave at a temperature in the range of about 500° F. to 1500° F. and a pressure in the range of 150 psig to 2700 psig while said plastic-containing sludge is in contact with hydrogen gas in the amount of about 0.1 to 1.0 parts by wt. of hydrogen gas per part by weight of plastic-containing sludge; wherein said reaction is continued until a pumpable slurry is produced comprising the following materials in weight percent at room temperature and pressure:

| | |
|---|---|
| a) a slurry comprising solubilized plastic, solubilized solid carbonaceous fuel and hydrocarbonaceous liquid solvent | 50 to 95 |
| b) unconverted organic and inorganic material | 5 to 50 |

4) separating a gas mixture comprising $H_2$, CO, $CO_2$, $C_1$–$C_6$ gases, $H_2O$, and a trace of $H_2S$ from the autoclave in (3), thereby leaving a pumpable slurry;

5) fractionating the degassed pumpable slurry from (4) in a distillation zone to produce:

a) a hydrocarbonaceous distillate comprising a mixture of $C_5$ to $C_{30}$ compounds selected from the group consisting of naphthenes, paraffins, aromatics, olefins, and mixtures thereof, and wherein said distillate has an initial atmospheric boiling point in the range of about 130° F. to 500° F., a viscosity in the range of about 100 to 1500 centipoise at room temperature, and a specific gravity of about 0.7 to 1.1;

b) a bottoms stream comprising aromatic and paraffinic hydrocarbonaceous materials containing $C_{20}$ or higher compounds in admixture with inorganic material from said plastic and solid carbonaceous fuel; wherein said bottoms stream has an initial boiling point in the range of about 300° F. to 1500° F., a viscosity in the range of about 1500 to 15,000 cP at room temperature, a solids content in the range of about 60 to 90 wt. %, a specific gravity of about 0.9–1.3; and 6) reacting by partial oxidation in a free-flow partial oxidation gasifier with a free-oxygen containing gas in the presence of a temperature moderator said bottoms stream (5) (b) to produce raw synthesis gas, fuel gas or reducing gas and nonhazardous slag.

2. The process of claim 1 wherein said pumpable liquid hydrocarbonaceous solvent is selected from the group consisting of petroleum distillates and residues, crude petroleum, asphalt, gas oil, residual oil, tar sand oil and shale oil, coal derived oil, aromatic hydrocarbons, coal tar, cycle gas oil from fluid-catalytic-cracking operations, furfural extract of coker gas oil and mixtures thereof.

3. The process of claim 1 wherein said pumpable liquid hydrocarbonaceous solvent meets ASTM Specification D2226, Types 101 and 102.

4. The process of claim 1 wherein said liquid hydrocarbonaceous solvent is a hydrocarbon oil having the following properties: initial atmospheric boiling point greater than 500° F., Neutralization No., mg KOH/g 0.70 to 1.0, and aniline point °F. 100 to 110.

5. The process of claim 1 wherein said plastic material is selected from the group consisting of polyesters, polyurethane, polyamide, polystyrene, cellulose acetate, polypropylene, and mixtures thereof.

6. The process of claim 1 where in (1) said plastic material is granulated to a particle size which passes through ASTM Ell Alternative Sieve Designation No. 7 or less.

7. The process of claim 1 where in (3) said liquefaction reaction takes place for a period in the range of about 5.0 minutes to 5.0 hr.

8. The process of claim 1 wherein the unconverted inorganic material (3) (c) has a density of greater than 1.2.

9. The process of claim 1 where in (6) said bottoms stream from (5) (b) is reacted with a free oxygen containing gas by partial oxidation in a free-flow refractory lined vertical gas generator at a temperature in the range of about 1800° F. to 3500° F., a pressure in the range of about 1 to 300 atmospheres, an atomic ratio O/C in the range of about 0.8–1.5 to 1.0, and a weight ratio of $H_2O$ to carbon in the range of about 0.2–3.0 to 1.0, to produce a hot raw effluent gas stream comprising $H_2$, CO, $CO_2$, $H_2O$, $H_2S$, COS, and optionally $N_2$.

10. The process of claim 9 provided with the step of purifying said raw effluent gas stream in a gas purification zone.

11. The process of claim 1 wherein said solid carbonaceous fuel is selected from the group consisting of coal, coke from coal, char from coal, coal liquefaction residues, petroleum coke, particulate carbon soot, solids derived from oil shale, tar sands, and pitch, and mixtures thereof.

12. The process of claim 1 provided with the step of introducing said gas mixture separated in (4) into said free-flow partial oxidation gasifier and reacting same by partial oxidation simultaneously with the partial oxidation reaction of said bottoms stream (5) (b).

13. The process of claim 2, wherein the aromatic hydrocarbons are selected from the group consisting of benzene, toluene, xylene fractions, and mixtures thereof.

* * * * *